US007575009B2

(12) United States Patent
Chang

(10) Patent No.: US 7,575,009 B2
(45) Date of Patent: Aug. 18, 2009

(54) MECHANISM FOR OPENING AND COLLAPSING UMBRELLA

(75) Inventor: Dragon Chang, Hsinchu (TW)

(73) Assignee: Golden Rain Enterprise Co., Ltd., Guangdong Province (CN)

( * ) Notice: Subject to any disclaimer, the term of this patent is extended or adjusted under 35 U.S.C. 154(b) by 89 days.

(21) Appl. No.: 11/730,403

(22) Filed: Apr. 2, 2007

(65) Prior Publication Data

US 2008/0087311 A1 Apr. 17, 2008

(30) Foreign Application Priority Data

Oct. 17, 2006 (CN) ..... 2006 1 0063180

(51) Int. Cl.
*A45B 25/08* (2006.01)

(52) U.S. Cl. ..... 135/28; 135/39; 135/43

(58) Field of Classification Search ..... 135/28–29, 135/37–41, 43; 403/109.1, 377; 285/313, 285/308

See application file for complete search history.

(56) References Cited

U.S. PATENT DOCUMENTS 508,189 A * 11/1893 Swan ..... 135/39
2,528,003 A * 10/1950 Katzberg ..... 135/39
3,258,021 A * 6/1966 Tartaglia ..... 135/43
3,424,180 A * 1/1969 Giancarlo ..... 135/28
5,911,233 A * 6/1999 Wu ..... 135/28
6,354,629 B1 * 3/2002 McNeal et al. ..... 280/823
6,758,229 B2 * 7/2004 Wang ..... 135/41
6,941,960 B2 * 9/2005 Huang ..... 135/41
7,281,542 B2 * 10/2007 Ko ..... 135/39
2005/0194027 A1 * 9/2005 Ko ..... 135/39
2005/0241687 A1 * 11/2005 Ko ..... 135/39

* cited by examiner

*Primary Examiner*—Winnie Yip
(74) *Attorney, Agent, or Firm*—Rosenberg, Klein & Lee

(57) ABSTRACT

A mechanism for opening and collapsing an umbrella includes a runner which has two lockers pivotably connected thereto and an operation collar is movably mounted to the shaft of the umbrella so as to operate the two lockers. Each of the lockers is a curved member and pivotably connected to the runner by a pivot. Two ends of the each locker are pivotable relative to the pivot in a direction perpendicular to an axis of the runner. The user simply moves the operation collar to pivot the lockers to open and collapse the umbrella.

10 Claims, 8 Drawing Sheets

C-C

C-C

C-C

C-C

MECHANISM FOR OPENING AND COLLAPSING UMBRELLA

FIELD OF THE INVENTION

The present invention relates to an operation collar which is movably mounted on the shaft of an umbrella which is opened and collapsed by moving the operation collar relative to the runner.

BACKGROUND OF THE INVENTION

A conventional mechanism for opening and collapsing an umbrella generally includes a button which is located at the runner. The button has a spring strip which is hooked to the shaft to position the runner when the umbrella is opened. When the umbrella is to be folded, the user pushes the button and the spring strip is disengaged from the shaft so that the umbrella is folded. However, the button is located on the runner which might be rotated during use of the umbrella so that when the user wants to push the button, he or she has to rotate the umbrella to find out where the button is. Besides, the button might be touched unintentionally so that this is not convenient to the users.

Another conventional mechanism for opening and collapsing umbrellas known to applicant is shown in FIG. 9. When the umbrella is opened, the operation member 5 is pushed upward to push the protrusion 64 of the pressing portion 62 of the spring plate 6 inward by the contact surface 521 so that the locking end 63 of the spring plate 6 is engaged with the positioning hole 80 in the shaft 8. When the operation member 5 is moved toward the stop 71 of the runner 7, the contact surface 51 is removed from the protrusion 64 so that the locking end 63 is removed form the position hole 80 and the runner 7 then can be moved along the shaft 8 to collapse the umbrella.

The runner 7 has to be made larger so that the operation member 5 and the spring plate 6 are able to be cooperated with the runner 5. The larger runner increases the space that the collapsed umbrella occupies. Besides, fatigue will be a main concern for the spring plate 6 after frequent uses and once the spring plate 6 cannot be precisely positioned as desired, the umbrella is in an unstable status.

The present invention intends to provide a mechanism for opening and collapsing an umbrella wherein the user can simply pull or push an operation collar to achieve the opening or collapsing of the umbrella.

SUMMARY OF THE INVENTION

The present invention relates to a mechanism for opening and collapsing an umbrella and the mechanism comprises a runner to which two lockers are pivotably connected thereto. Each locker is a curved member and pivotably connected to the runner by a pivot. Two ends of the each locker can be pivotable relative to the pivot in a direction perpendicular to an axis of the runner. An operation collar is removably connected to the runner so as to pivot the lockers to open or collapse the umbrella.

The primary object of the present invention is to provide a mechanism for opening and collapsing an umbrella, wherein an operation collar is removably connected to the runner to pivot two lockers which are pivoted about two respective pivots and the two wings of each locker are horizontally pivoted about the pivot.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
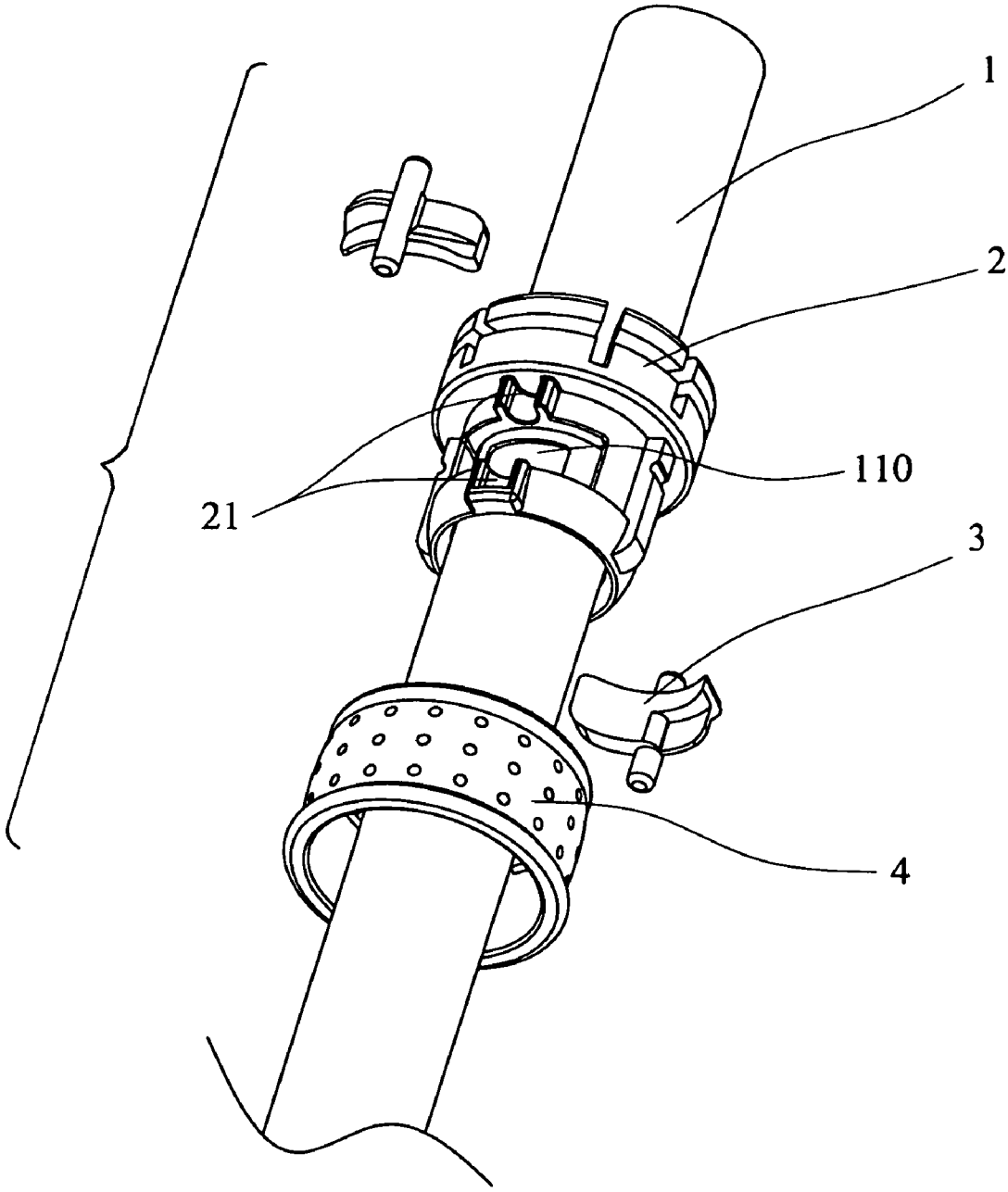
FIG. 1 is an exploded view to show two lockers and the runner and the operation collar on the shaft of an umbrella of the present invention.
Figure 2:
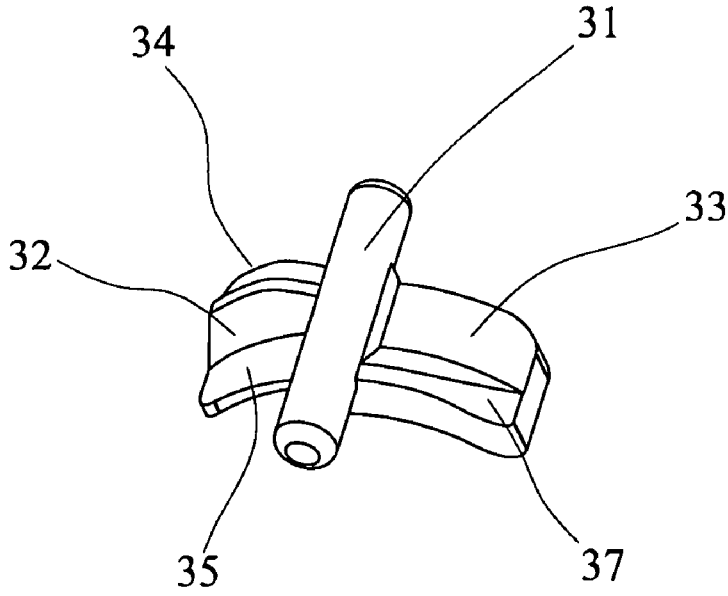
FIG. 2 shows the first side of each of the lockers of the present invention.
Figure 3:
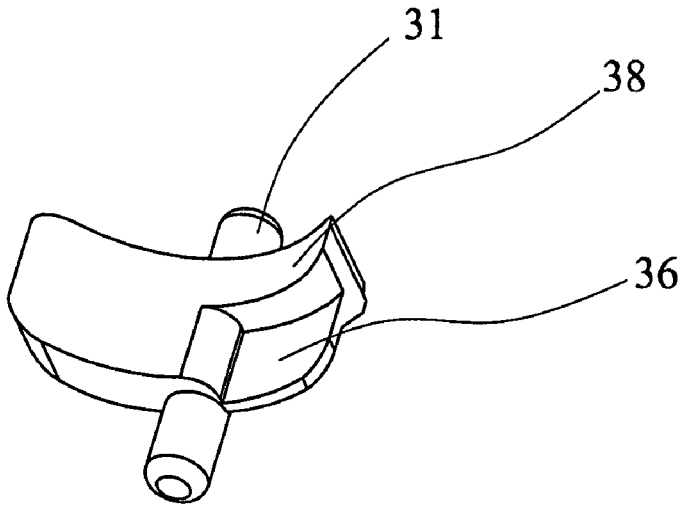
FIG. 3 shows the second side of each of the lockers of the present invention.
Figure 4A:
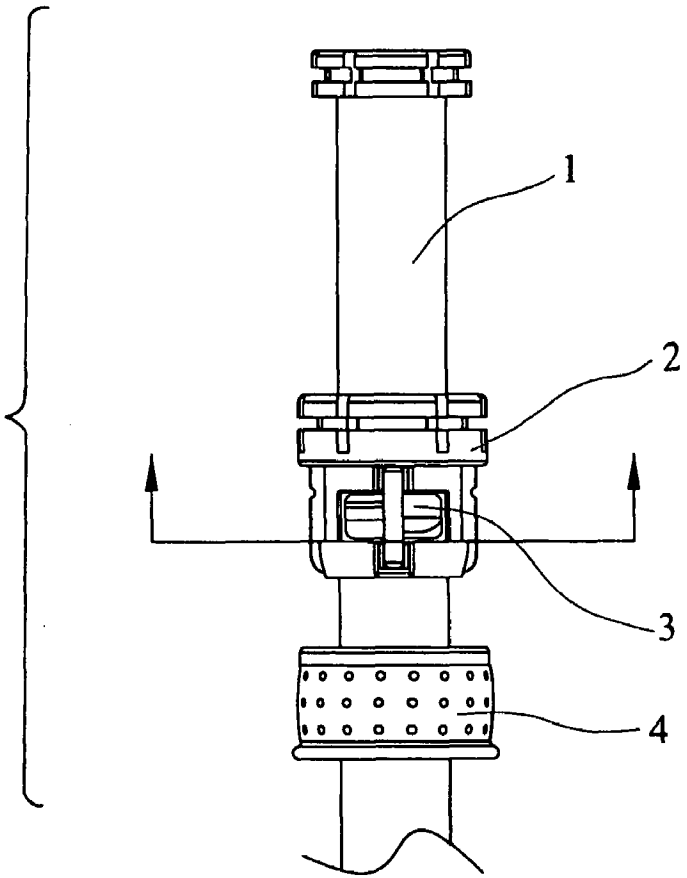
FIG. 4A shows a side view of the runner and the operation collar on the shaft.
Figure 4:
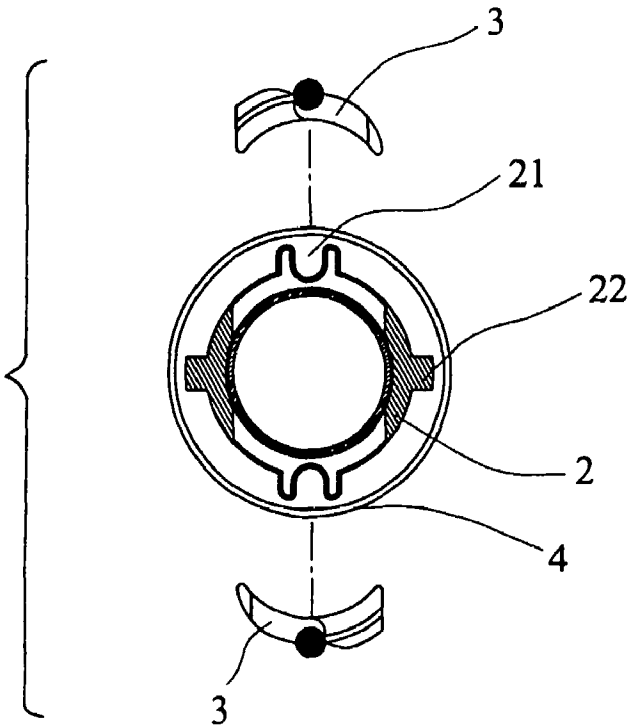
FIG. 4 shows a top view of the runner and the two lockers.
Figure 6:
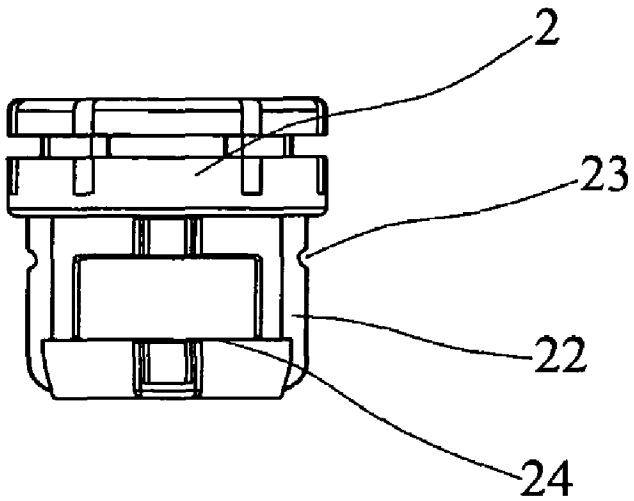
FIG. 6 is a side view of the runner.
Figure 5:
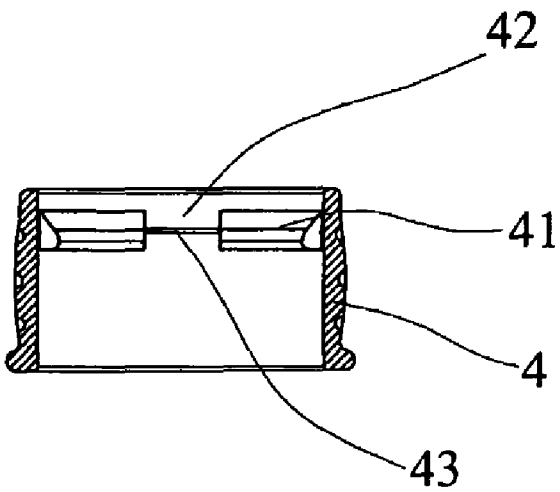
FIG. 5 is a cross sectional view of the operation collar.
Figure 7A:
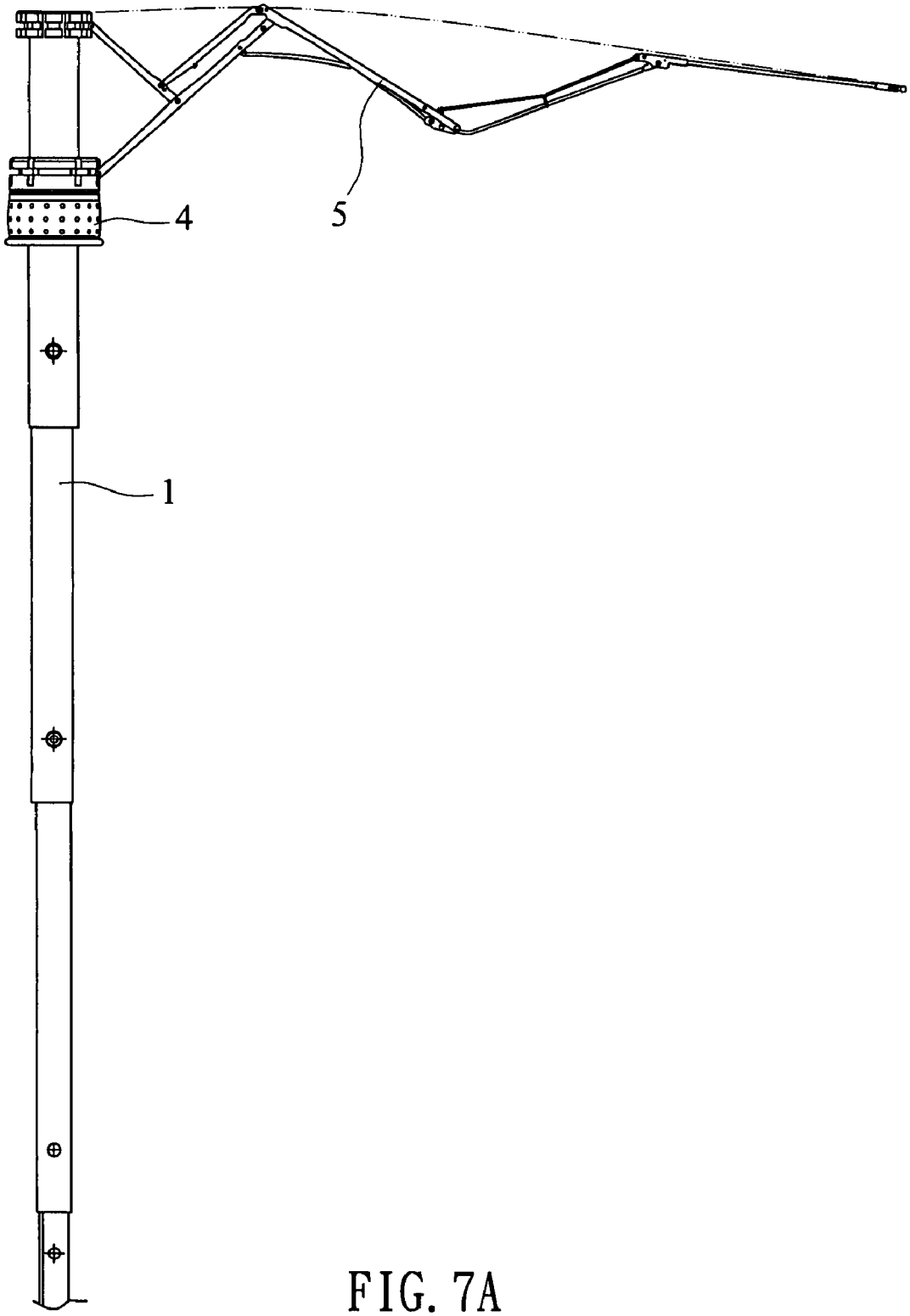
FIG. 7A shows the umbrella with the runner and the operation collar on the shaft.
Figure 7B:
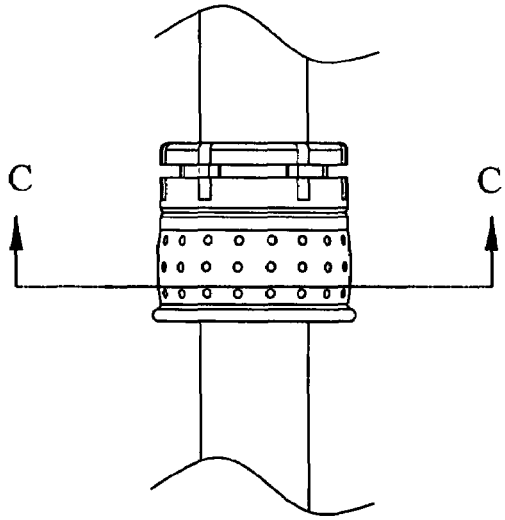
FIG. 7B shows the operation collar is connected to the runner.
Figure 7C:
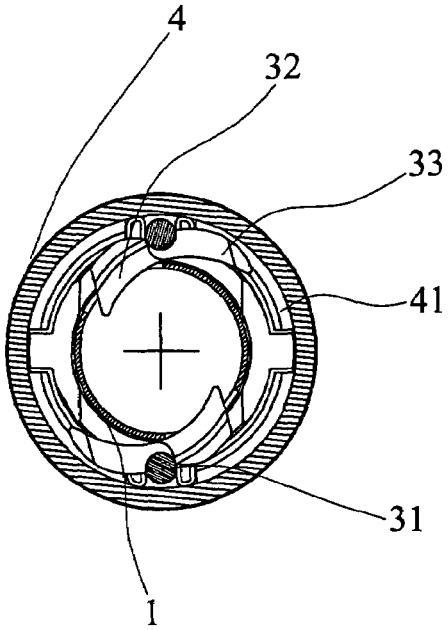
FIG. 7C shows a cross sectional view along line C-C in FIG. 7B.
Figure 7D:
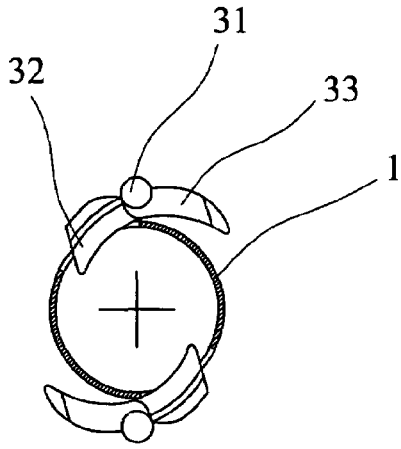
FIG. 7D shows the two lockers are pivoted by the operation collar.

Referring to FIG. 7A, the umbrella includes a shaft 1 with a runner 2 movably mounted on the shaft 1 and stretchers 5 are pivotably connected between the runner 2 and ribs. As shown in FIGS. 1, 2, 3, 4, 4A, 5, and 6, the mechanism for opening and collapsing an umbrella of the present invention comprises the runner and an operation collar 4 which is removably connected to the runner. Both of the runner 2 and the operation collar 4 are mounted on the shaft 1 of the umbrella.

The runner 2 has two C-shaped slots 21 defined therein and two lockers 3 are pivotably engaged with the slots 21. The lockers 3 are connected to the runner 2 symmetrically. Each of the lockers 3 is a curved member and pivotably connected to the runner 2 by two respective pivots 31. Each locker 3 includes a first wing 32, a second wing 33 and the pivot 31 which is located between the first and second wings 32, 33. Each of the lockers 3 has a positioning hole 110 and the pivot 31 is located in the positioning hole 110, two ends of the pivot 31 are engaged with two of the slots 21 of the runner 2. A first protrusion 34 extends from a first side of a top edge of the first wing 32 of each of the lockers 3 and an engaging portion is formed on a second side of the first wing 32 of the locker 3 and located corresponding to the first protrusion 34. The engaging portion is formed on the second side of the locker 3 and is a stepped area. A second protrusion 37 extends from a first side of a low edge of the second wing 33 of each of the lockers 3 and an engaging portion is formed on a second side of the second wing 32 of the locker 3 and located corresponding to the second protrusion 37. A first recess 35 is defined in the second side of the first wing 32. A second recess 36 is defined in the second side of the second wing 33. The second wing 33 has a contact surface 38 extending from the second side thereof and located at top edge of the second wing 33. The first protrusion 34 of the first wing 31 is higher than the first side of the first wing 33.

The operation collar 4 includes insertions 41 extending from an inner periphery of a top thereof and an inner diameter of a space partially enclosed by the insertions 41 is less than an outer diameter of a lower end of the runner 2. The runner 2 has two ridges 22 extending from an outer periphery thereof and the two ridges 22 are located between the lockers 3. The operation collar 4 has gaps 42 defined in an inner periphery thereof and the gaps 42 so that the ridges 22 are engaged therewith, this ensures that the operation collar 4 will not shake in horizontal direction. Each of the ridges 22 has a notch 23 and the operation collar 4 has ribs 43 which are engaged with the notches 23. By the engagement of the ridges 22 and the notches 23, the operation collar 4 is not moved easily.

The first recess 35 allows the operation collar 4 not to be tangled with the locker 3. The first protrusion 34 includes a stepped portion about 0.2 mm high so that when the operation collar 4 moves to the positioning holes 110, the insertions 41 on the operation collar 4 are engaged with the stepped portion of the first protrusions 34 of the two lockers 3 such that the operation collar 4 can be positioned and the umbrella is not collapsed unintentionally. The insertions 41 compress the first protrusions 34 of the first wings 32 and the contact surface 38 of the first wing 32 is engaged with the positioning holes 110 to ensure that the umbrella is opened.

As shown in FIGS. 7A to 7D, when opening the umbrella, the operation collar 4 is moved upward along the shaft 1 and the insertions 41 compress the first protrusions 34 so that the lockers 3 are pivoted to let the contact surfaces 38 engage with the positioning holes 110 in the shaft 1 to ensure that opening of the umbrella.

Figure 8:
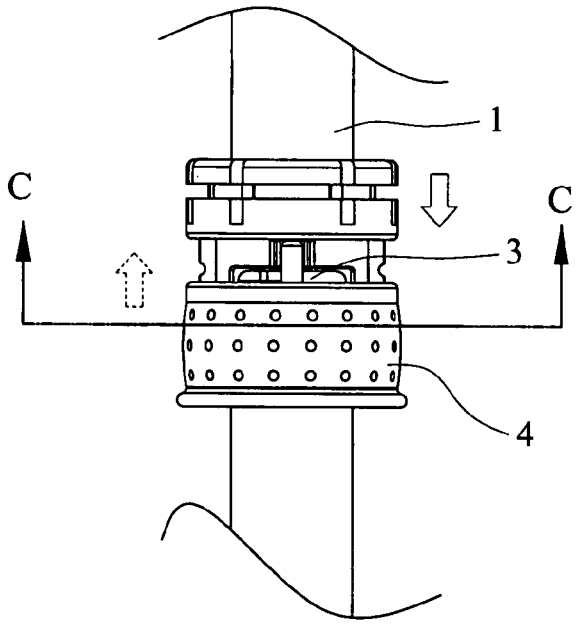
FIG. 8 shows that the operation collar is disengaged from the runner.
Figure 8A:
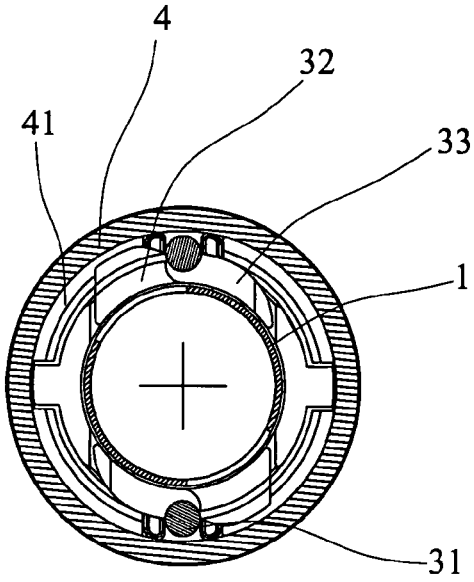
FIG. 8A shows a cross sectional view along line C-C in FIG. 8.
Figure 8B:
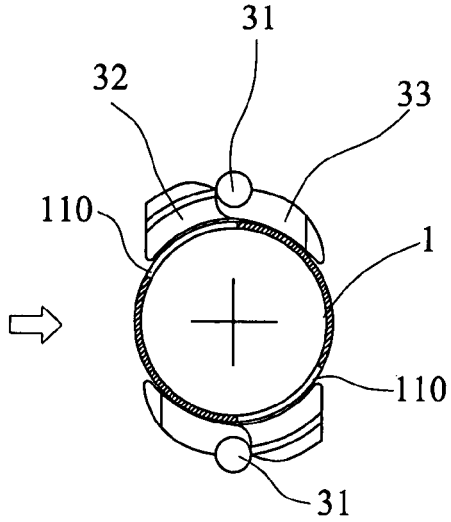
FIG. 8B shows that the status two lockers when the operation collar is removed from the runner.
Figure 9:
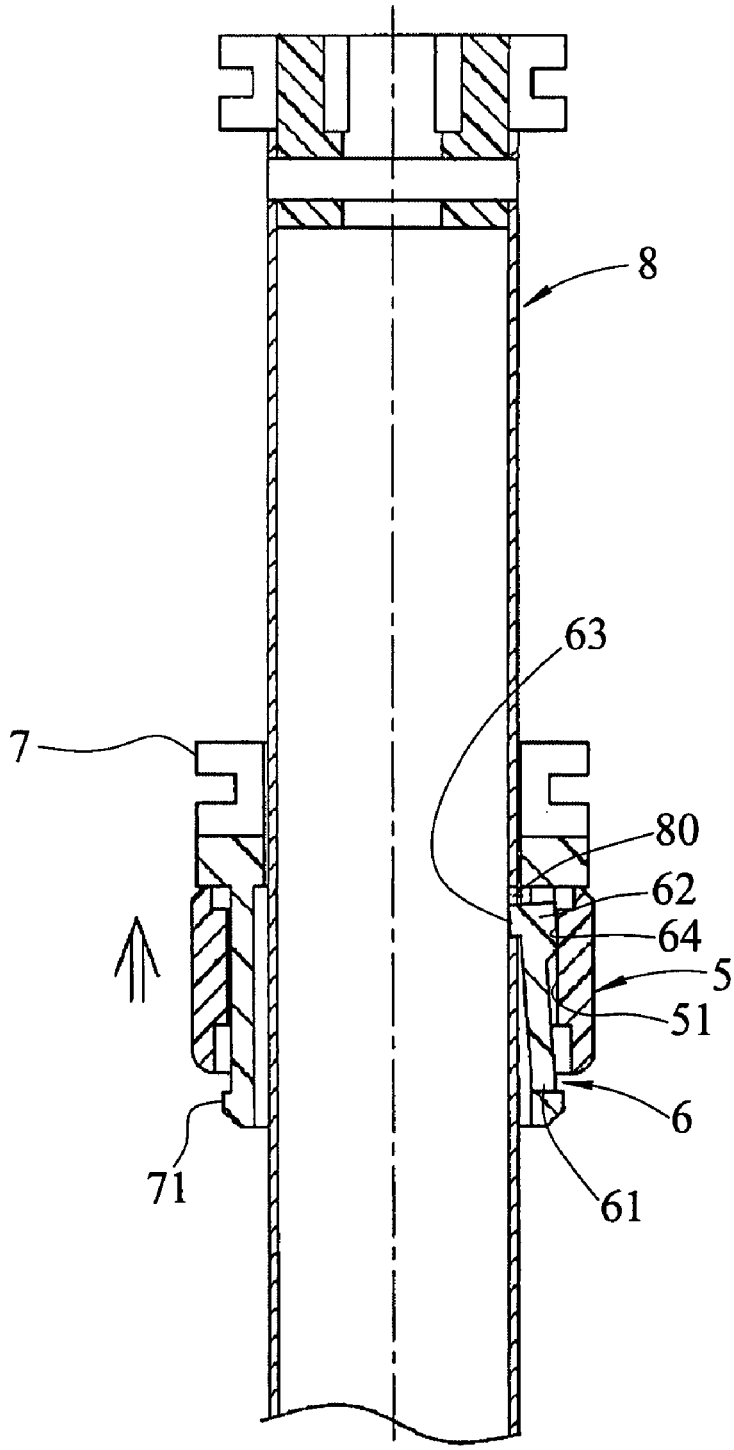
FIG. 9 PRIOR ART
FIG. 9 shows a conventional mechanism for opening and collapsing an umbrella.

When collapsing the umbrella, referring to FIGS. 8-8B, the operation collar 4 is moved downward and in contact with the end surface 24 of the lower end of the runner 2. The insertions 41 compress the second protrusions 37 so that the first wings 32 are pivoted outward and the contact surfaces 38 are removed from the positioning holes 110. Because the insertions 41 extend from the inner periphery of the operation collar 4 and the inner diameter of a space partially enclosed by the insertions 41 is less than an outer diameter of a lower end of the runner 2, so that the operation collar 4 can be connected with the runner 2 when the insertions 41 are in contact with the end surface 24 of the runner 2.

While we have shown and described the embodiment in accordance with the present invention, it should be clear to those skilled in the art that further embodiments may be made without departing from the scope of the present invention.

What is claimed is:

1. A mechanism for opening and collapsing an umbrella which includes a longitudinally extended shaft, comprising:

a runner having an operation collar displaceably connected thereto, the operation collar and the runner being removably mountable to the shaft of the umbrella, the runner having two lockers each including being a curved member and being pivotally connected to the runner by two respective pivots each defining a pivot axis extending in a longitudinal direction relative to the shaft, two ends of the each locker being pivotally displaceable about pivotable relative to the pivot axis in a direction substantially perpendicular to an axis of the runner, and the operation collar selectively locking the runner relative to the longitudinally extended shaft.

2. The mechanism as claimed in claim 1, wherein the runner has slots defined therein and the lockers are pivotably engaged with the slots, a first protrusion extends from a first side of each of the lockers and an engaging portion is formed on a second side of the locker and located corresponding to the first protrusion.

3. The mechanism as claimed in claim 2, wherein each of the lockers includes a first wing and a second wing, the pivot is located between the first and second wings, the first wing including a first protrusion and a first recess defined thereon, a second recess being defined on the second wing.

4. The mechanism as claimed in claim 3, wherein the second wing has a contact surface extending from a side thereof and located at a top edge.

5. The mechanism as claimed in claim 2, wherein the engaging portion formed on the second side of the locker is a stepped area.

6. The mechanism as claimed in claim 1, wherein each of the lockers is pivotally displaceable to engage, two ends of the pivot of each locker are engaged with two slots defined by the runner.

7. The mechanism as claimed in claim 1, wherein the lockers are connected to the runner symmetrically.

8. The mechanism as claimed in claim 1, wherein the operation collar includes insertions extending from an inner periphery of a top thereof and an inner diameter of a space partially enclosed by the insertions is less than an outer diameter of a lower end of the runner.

9. The mechanism as claimed in claim 8, wherein the runner has two ridges extending from an outer periphery thereof and the two ridges are located between the lockers, the operation collar has gaps defined in an inner periphery thereof and the gaps so that the ridges are engaged therewith.

10. The mechanism as claimed in claim 9, wherein each of the ridges has a notch and the operation collar has ribs which are engaged with the notches.

* * * * *